US011927029B2

(12) United States Patent
Kim

(10) Patent No.: US 11,927,029 B2
(45) Date of Patent: Mar. 12, 2024

(54) ANTI-SEISMIC REINFORCEMENT STRUCTURE USING PANEL ZONE REINFORCING FIXTURES AND CONSTRUCTION METHOD THEREFOR

(71) Applicant: ARISU ENGINEERING CO., LTD., Seoul (KR)

(72) Inventor: Eui Yong Kim, Seoul (KR)

(73) Assignee: ARISU ENGINEERING CO., LTD., Seoul (KR)

( * ) Notice: Subject to any disclaimer, the term of this patent is extended or adjusted under 35 U.S.C. 154(b) by 244 days.

(21) Appl. No.: 17/618,909

(22) PCT Filed: Sep. 15, 2020

(86) PCT No.: PCT/KR2020/012440
§ 371 (c)(1),
(2) Date: Dec. 14, 2021

(87) PCT Pub. No.: WO2021/054698
PCT Pub. Date: Mar. 25, 2021

(65) Prior Publication Data

US 2022/0259880 A1 Aug. 18, 2022

(30) Foreign Application Priority Data

Sep. 16, 2019 (KR) ..... 10-2019-0113456

(51) Int. Cl.
*E04H 9/02* (2006.01)

(52) U.S. Cl.
CPC ..... *E04H 9/027* (2013.01); *E04H 9/021* (2013.01)

(58) Field of Classification Search
CPC ..... E04H 9/027; E04H 9/021; E04H 9/025; E04H 9/0237; E04G 23/0218
(Continued)

(56) References Cited

U.S. PATENT DOCUMENTS 3,495,371 A * 2/1970 Mitchell, Jr. ..... E04B 1/215 52/236.7
7,225,588 B2 * 6/2007 Nakamura ..... F16F 7/00 52/167.3
(Continued)

FOREIGN PATENT DOCUMENTS

JP 09-279695 A 10/1997
JP 2009-097165 A 5/2009
(Continued)

OTHER PUBLICATIONS

International Search Report for PCT/KR2020/012440 dated Dec. 10, 2020 from Korean Intellectual Property Office.

*Primary Examiner* — Brent W Herring
(74) *Attorney, Agent, or Firm* — Revolution IP, PLLC

(57) ABSTRACT

An anti-seismic reinforcement structure using a panel zone reinforcing fixture, according to the present invention, comprises: panel zone reinforcing fixtures which are coupled, to reinforce an existing frame consisting of a column and a beam as existing members, to one side of the frame and which are respectively fixed to sides of the column and the beam at a panel zone where the existing column and the existing beam are joined to each other; a reinforcing column which is installed at one side of the column and has opposite ends thereof fixed to the panel zone reinforcing fixtures; and a reinforcing beam which is installed at one side of the beam and has opposite ends thereof fixed to the panel zone reinforcing fixtures.

7 Claims, 18 Drawing Sheets

(58) Field of Classification Search
USPC ..... 52/251, 252, 327, 414, 167.3
See application file for complete search history.

(56) References Cited

U.S. PATENT DOCUMENTS

| | | | | |
|---|---|---|---|---|
| 8,505,260 | B1 * | 8/2013 | Chang | E04H 9/0237 52/704 |
| 2015/0259899 | A1 * | 9/2015 | Tsai | E04B 1/98 248/542 |
| 2019/0136520 | A1 * | 5/2019 | Daudet | E04B 2/62 |

FOREIGN PATENT DOCUMENTS

| | | | | |
|---|---|---|---|---|
| KR | 20110016662 | A * | 2/2011 | E04H 9/027 |
| KR | 10-1060708 | B1 | 8/2011 | |
| KR | 10-1185974 | B1 | 9/2012 | |
| KR | 10-1379892 | B1 | 4/2014 | |
| KR | 20180098450 | A * | 2/2017 | E04H 9/021 |
| KR | 10-1778040 | B1 | 9/2017 | |
| KR | 10-1820628 | B1 | 1/2018 | |
| KR | 101840401 | B1 * | 3/2018 | E04G 23/0218 |
| KR | 10-1901435 | B1 | 9/2018 | |
| KR | 101909198 | B1 * | 10/2018 | E04G 23/0218 |
| KR | 10-1950954 | B1 | 2/2019 | |
| KR | 20200054829 | A * | 5/2020 | E04H 9/027 |
| KR | 102265916 | B1 * | 6/2021 | E04G 23/0218 |
| WO | WO-2015088297 | A1 * | 6/2015 | E04C 3/34 |
| WO | WO-2018070634 | A1 * | 4/2018 | E04B 1/98 |
| WO | WO-2021241859 | A1 * | 12/2021 | E04G 23/0218 |

* cited by examiner

[FIG 1]
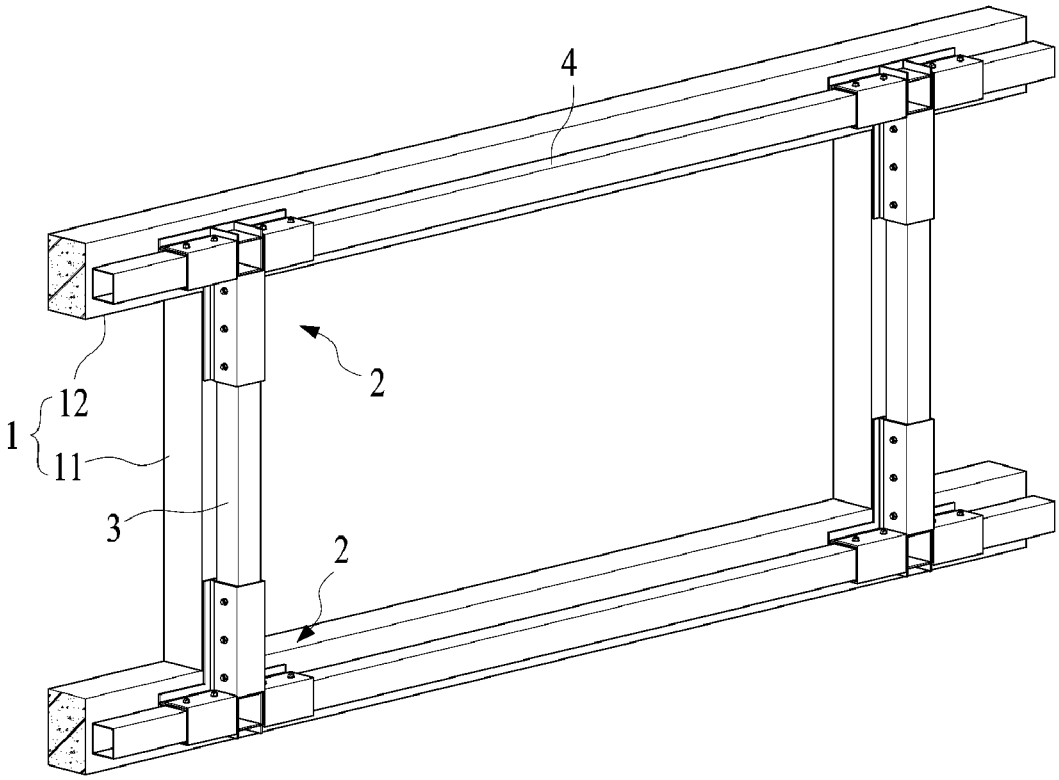

[FIG 2]
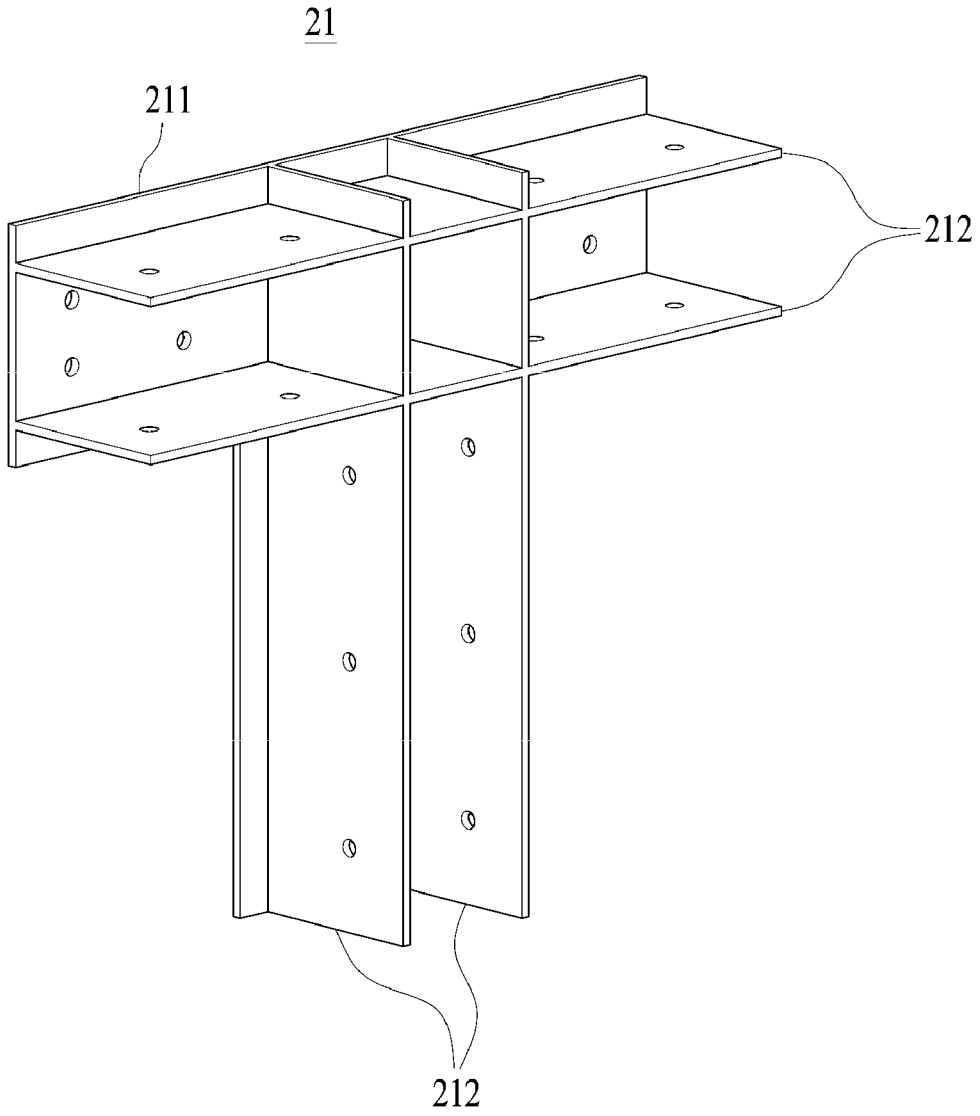

[FIG 3]
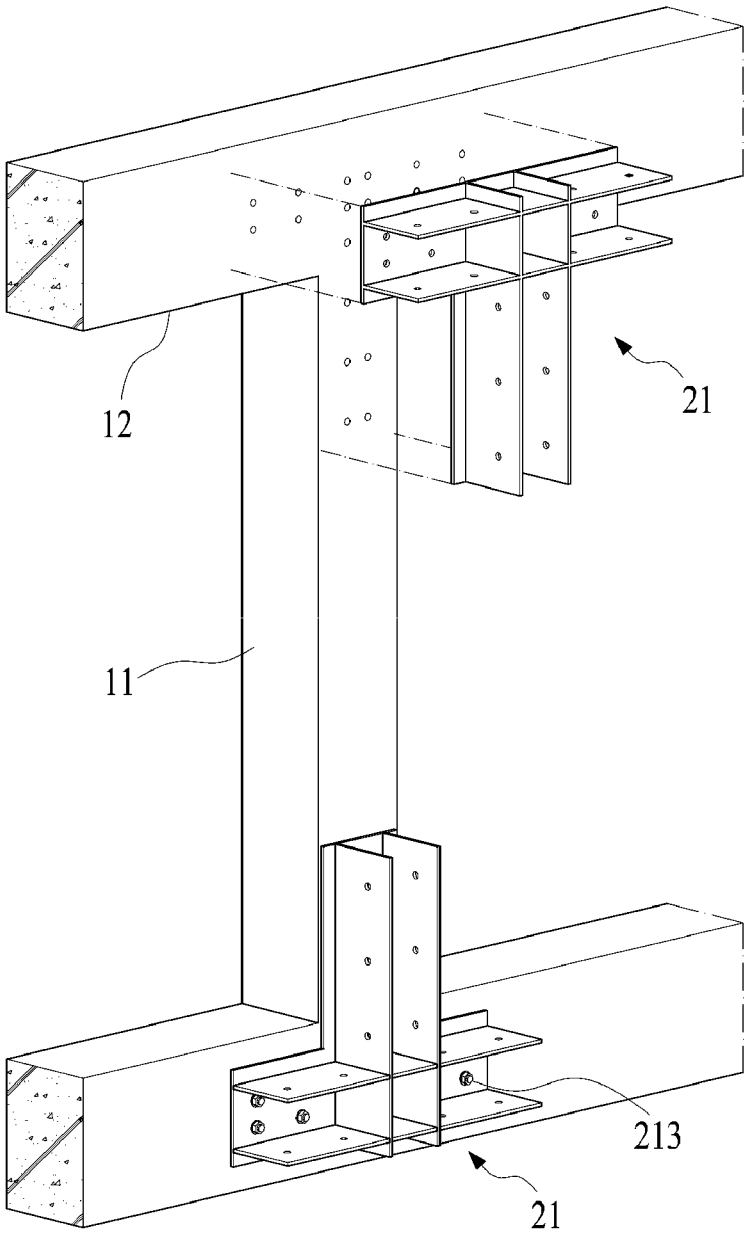

[FIG 4]
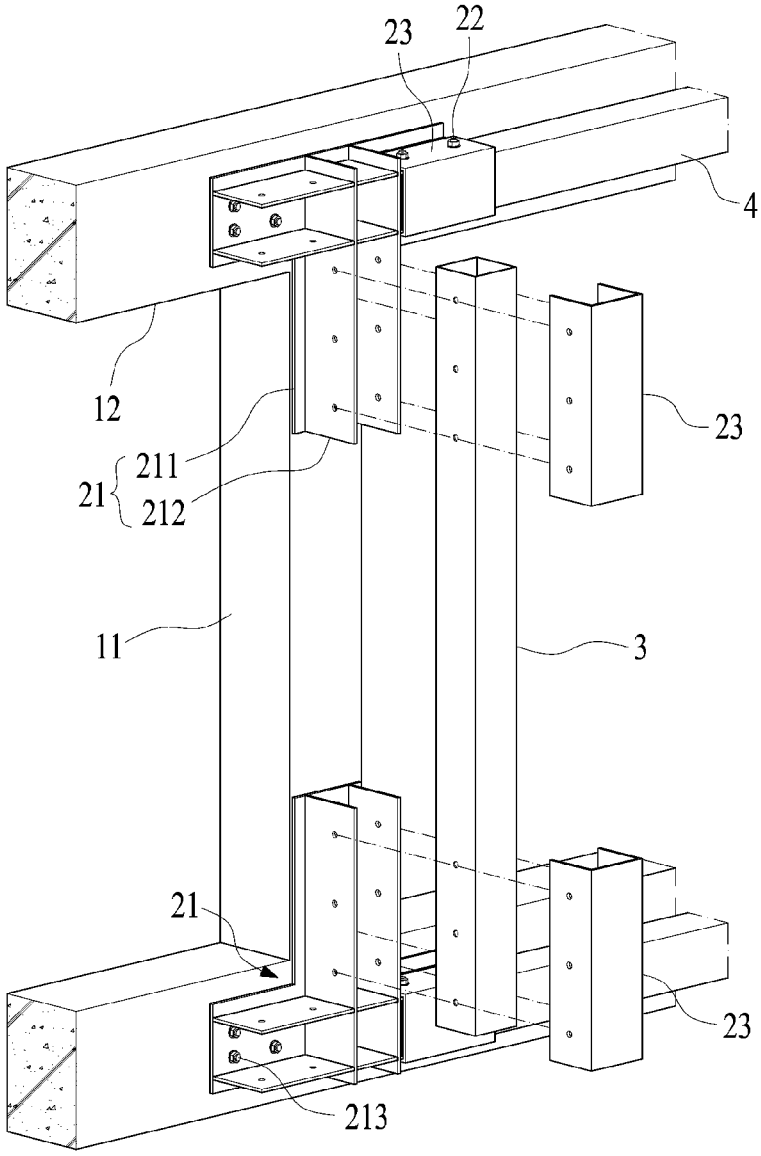

[FIG 5]
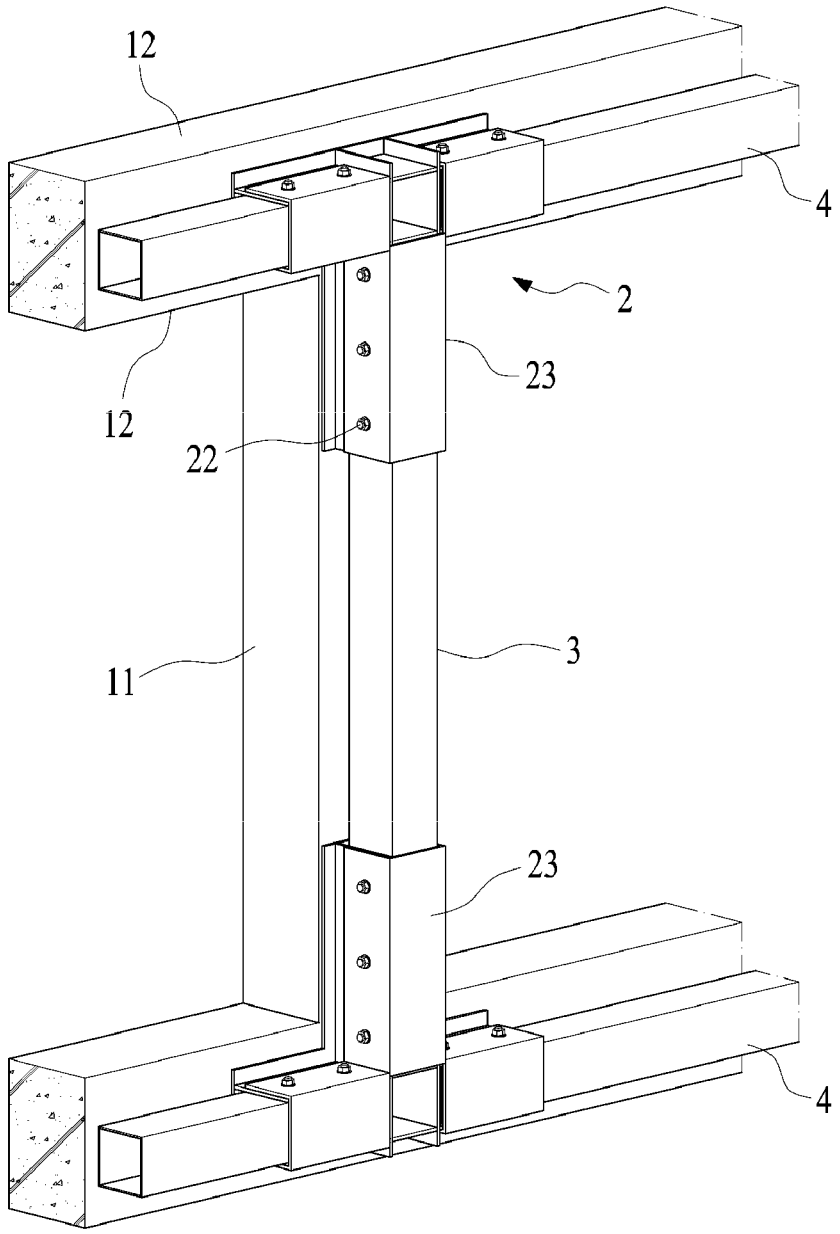

[FIG 6]
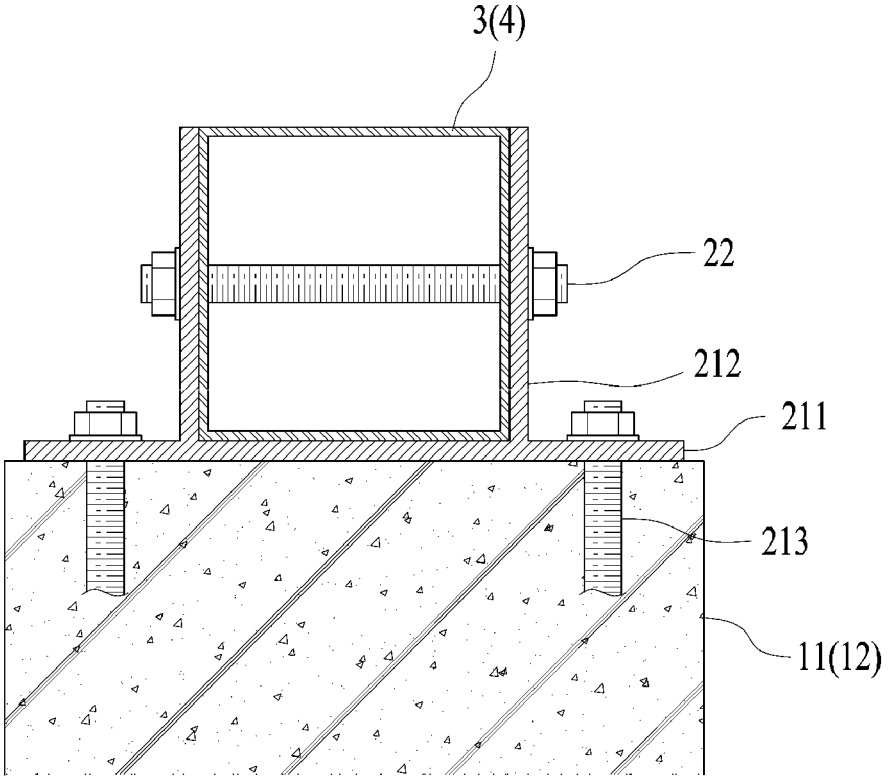

[FIG 7]
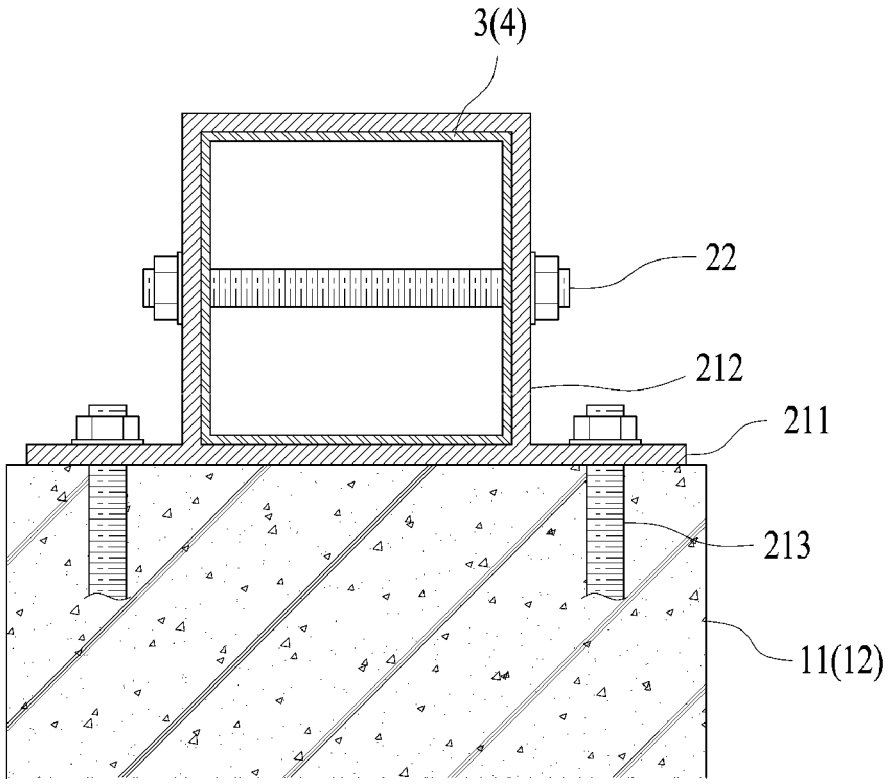

[FIG 8]
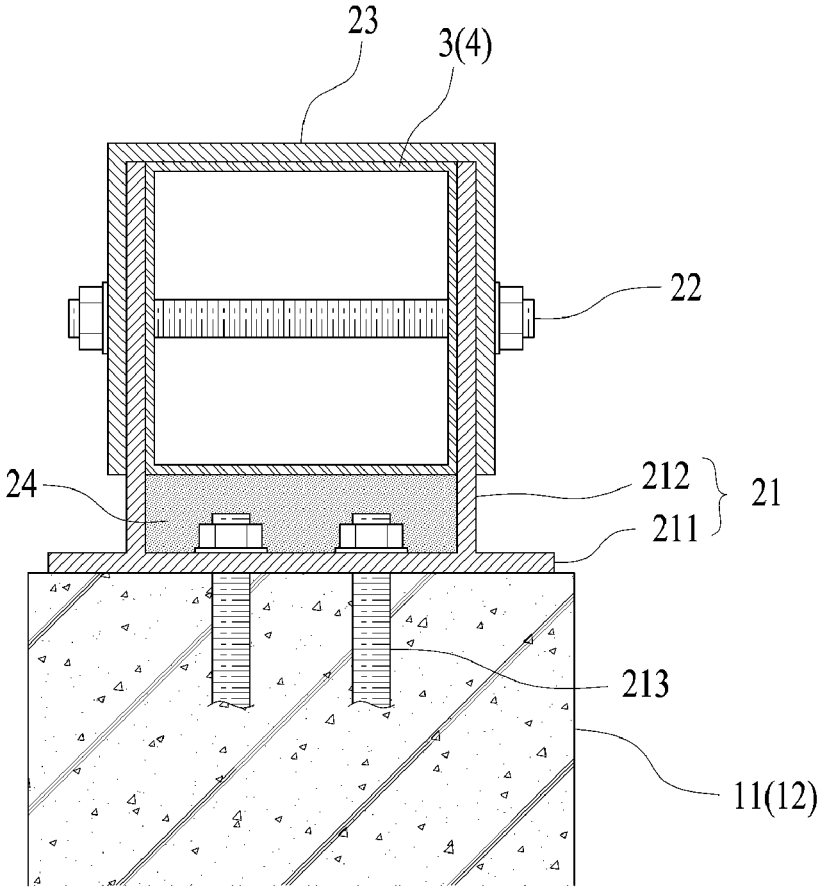

[FIG 9]
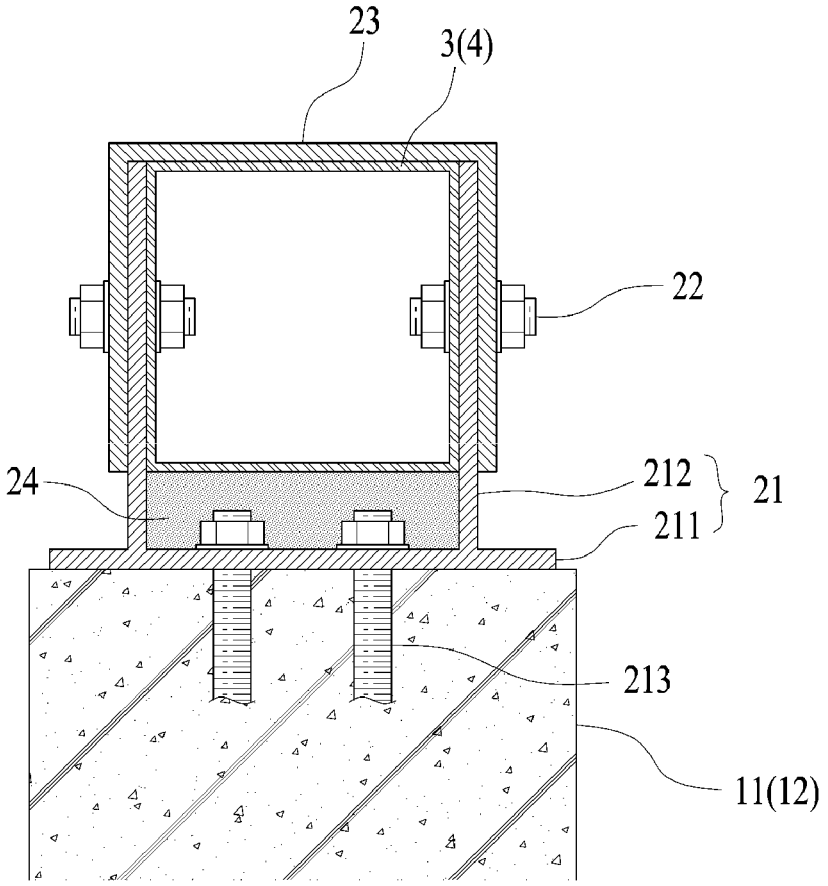

[FIG 10]
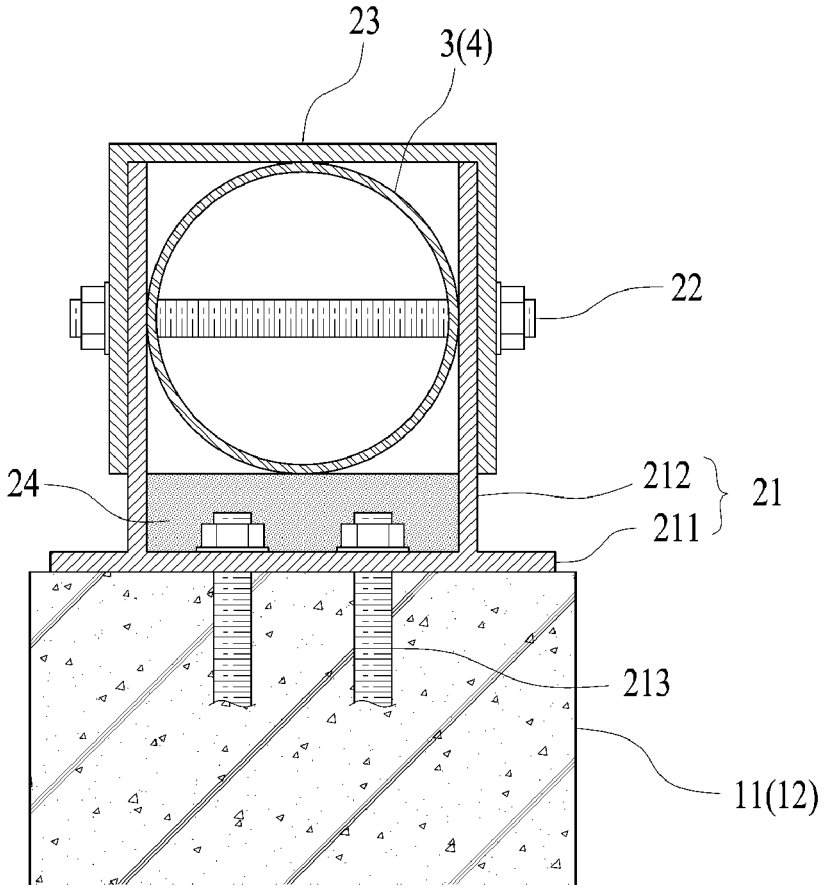

[FIG 11]
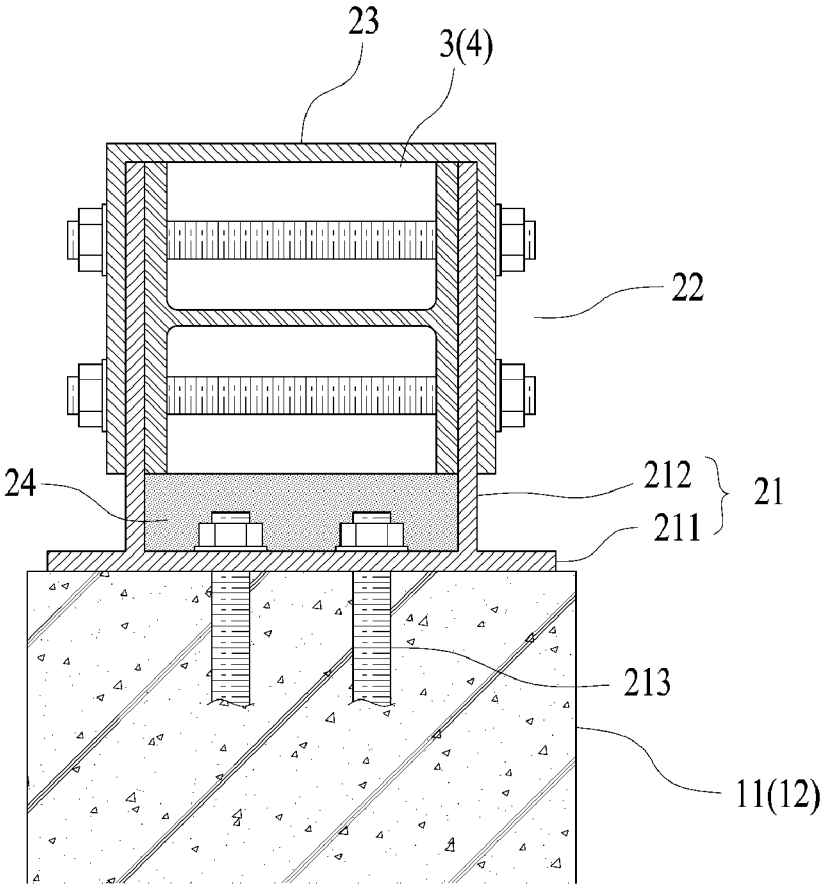

[FIG 12]
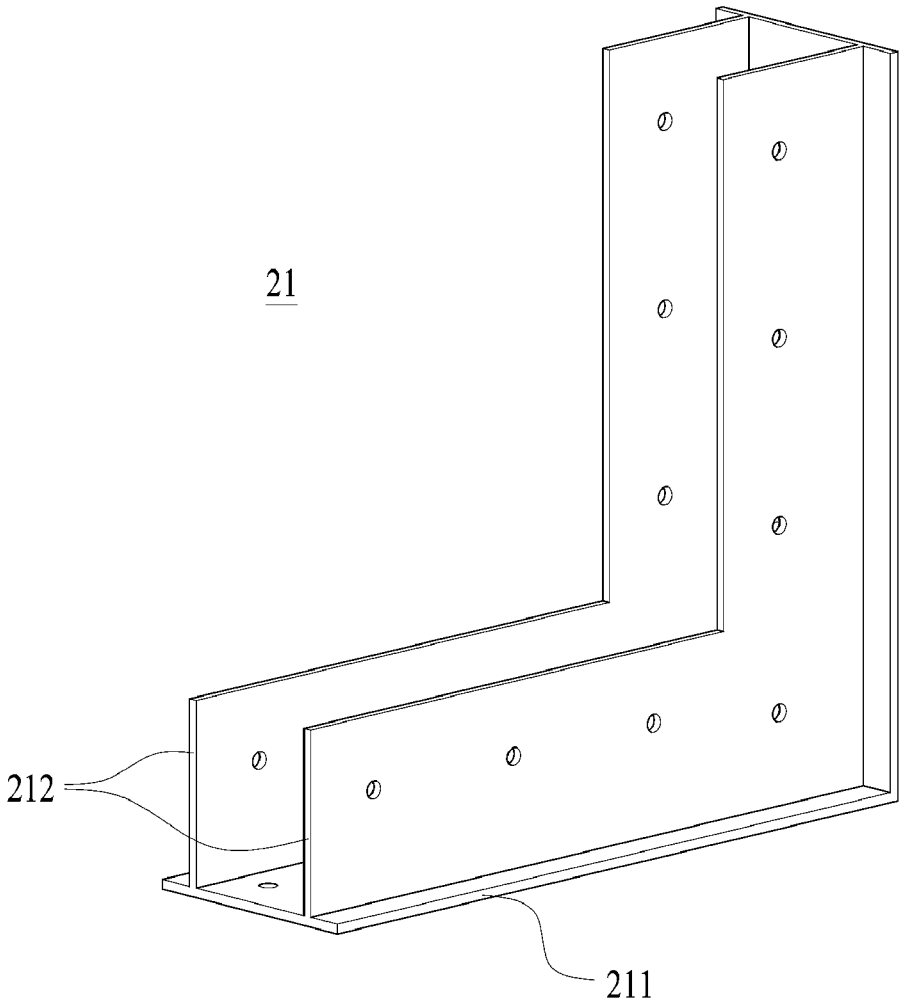

[FIG 13]
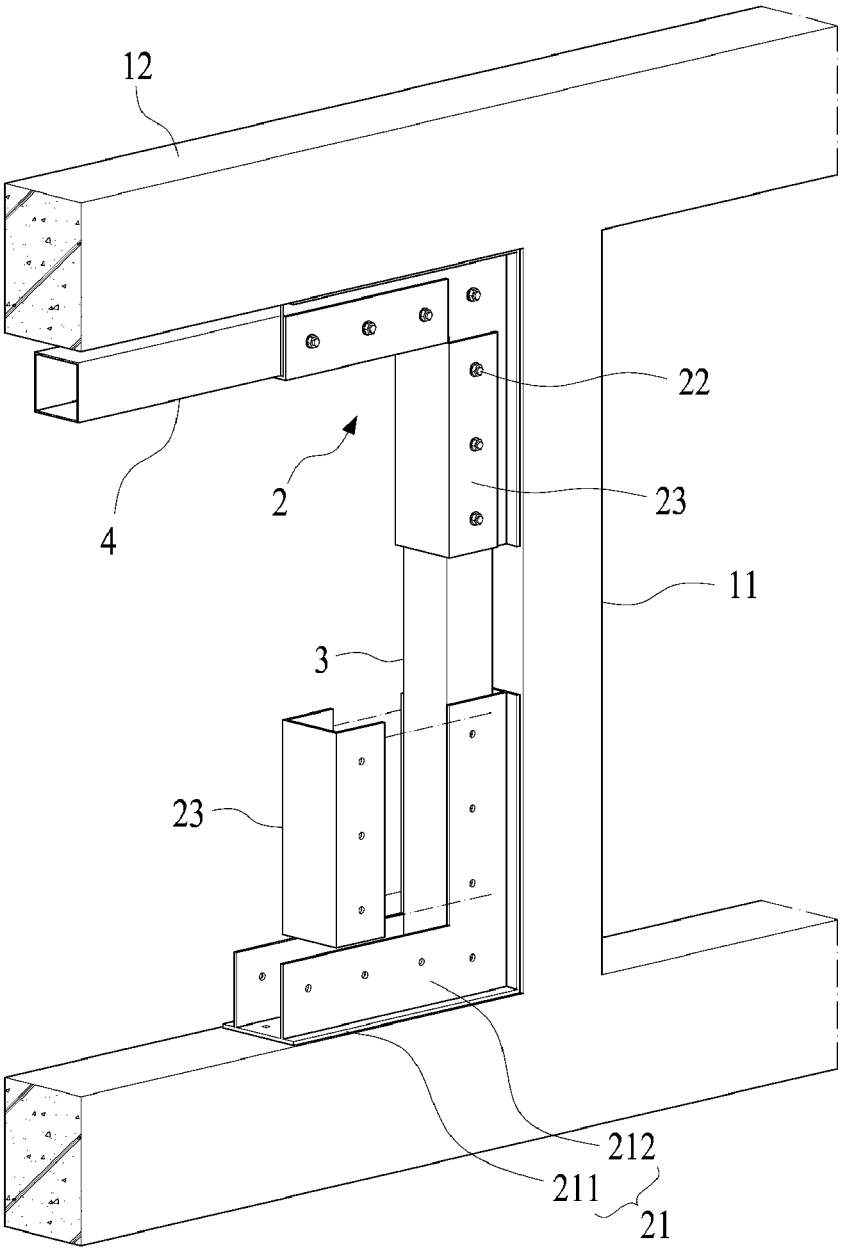

[FIG 14]
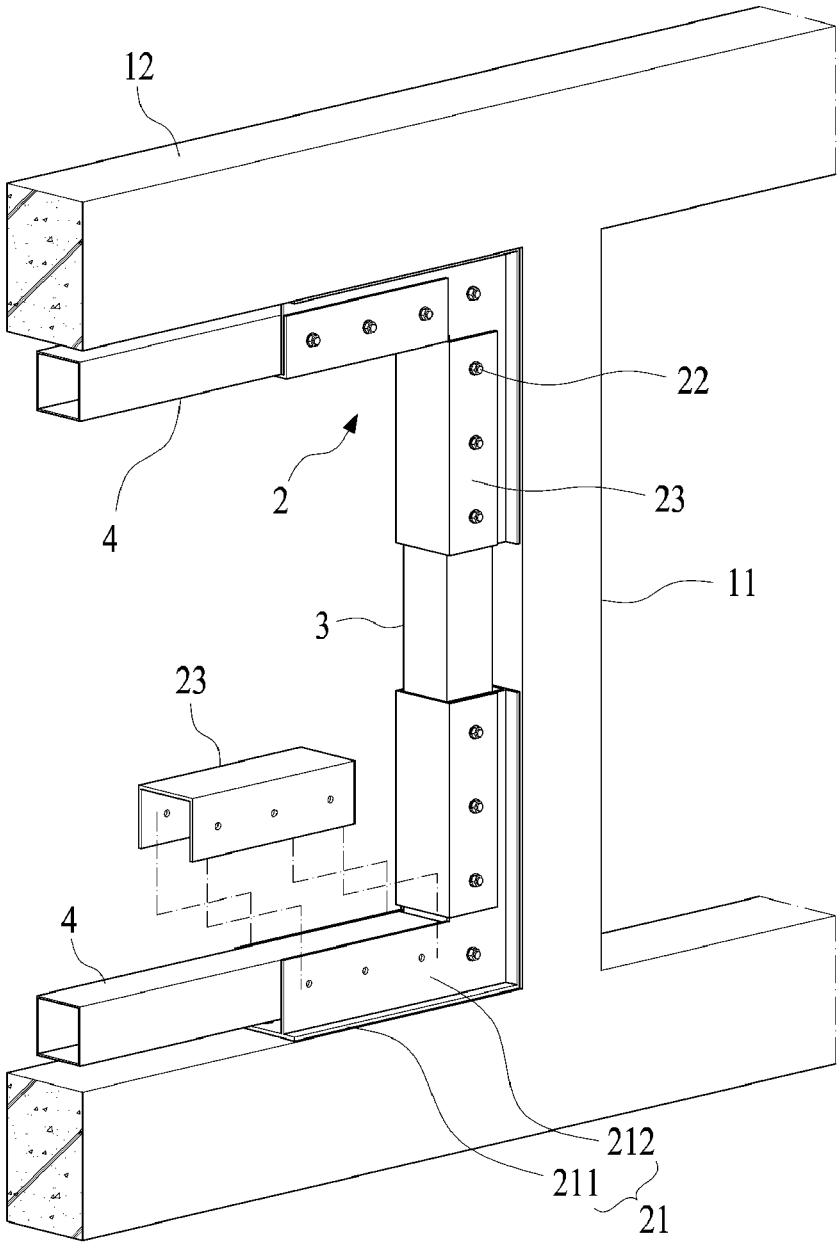

[FIG 15]
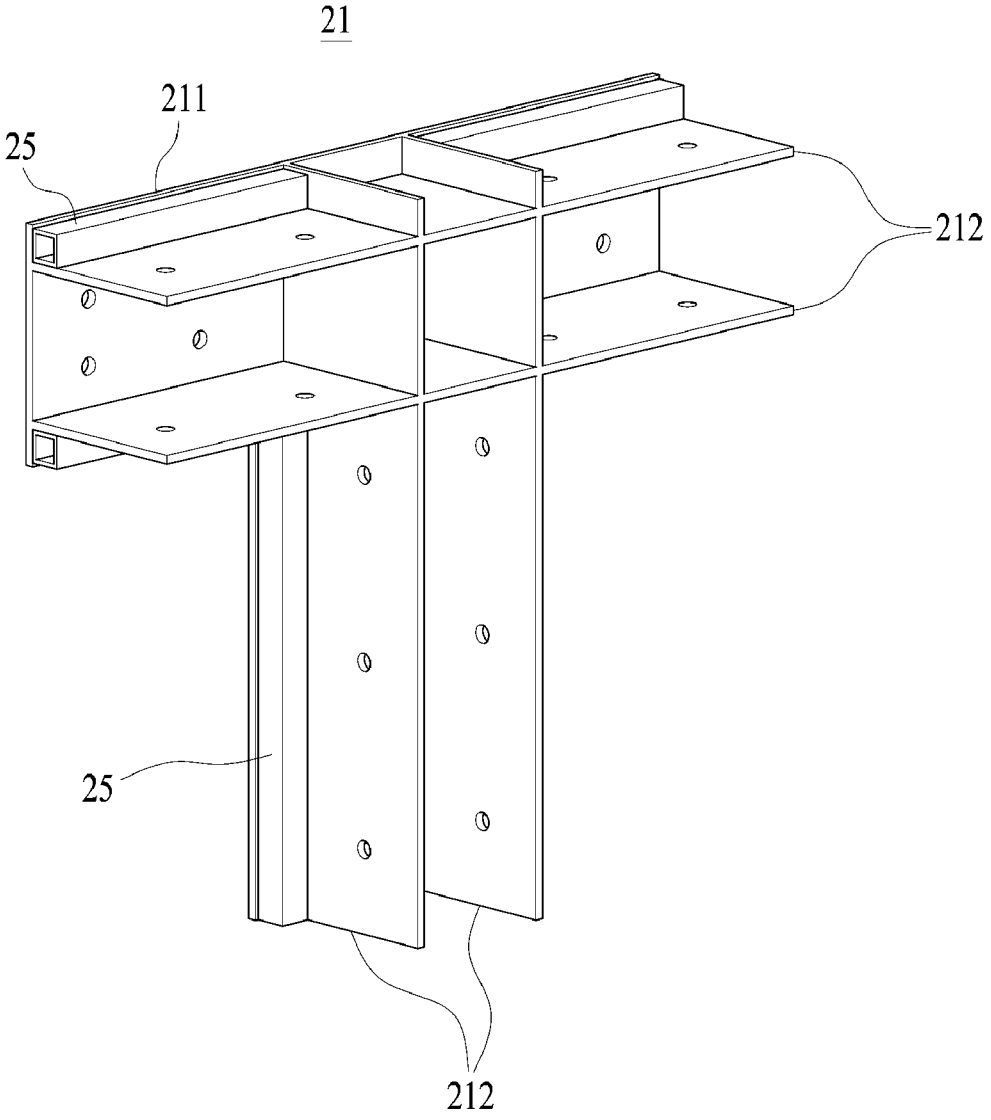

[FIG 16]
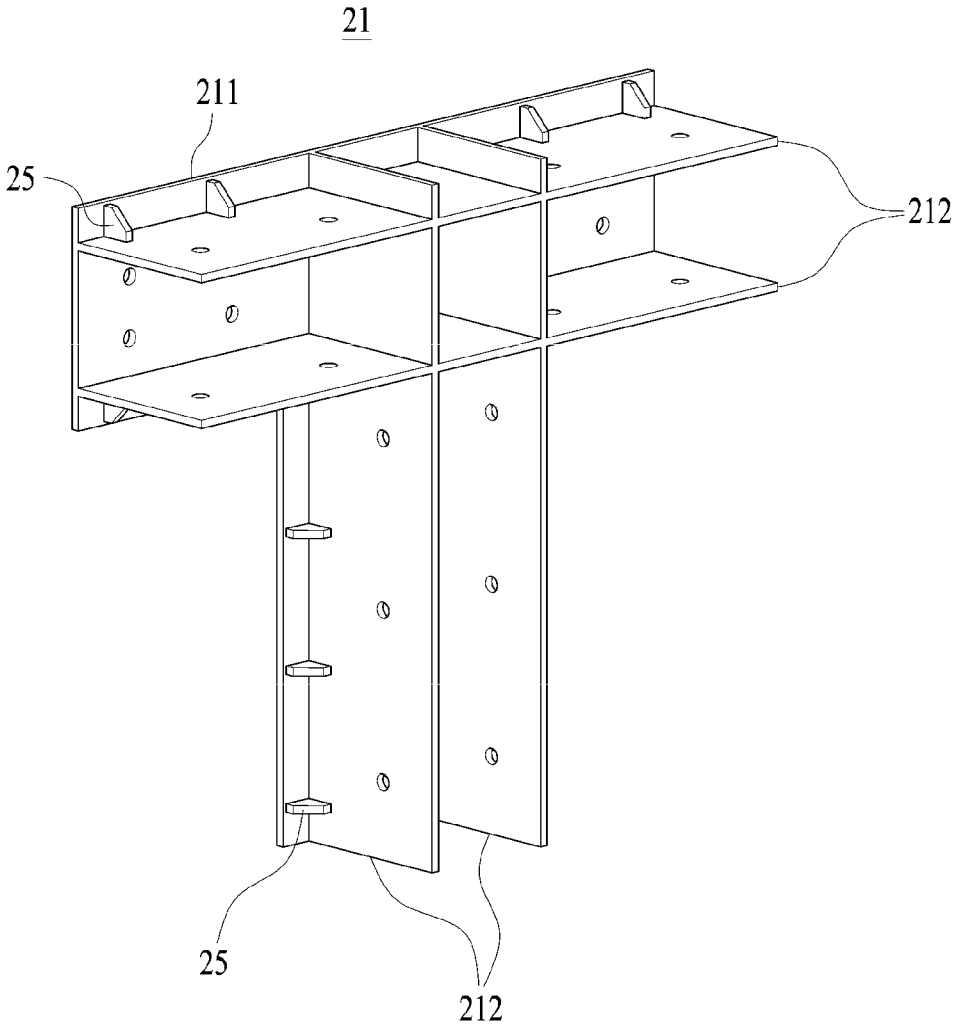

[FIG 17]
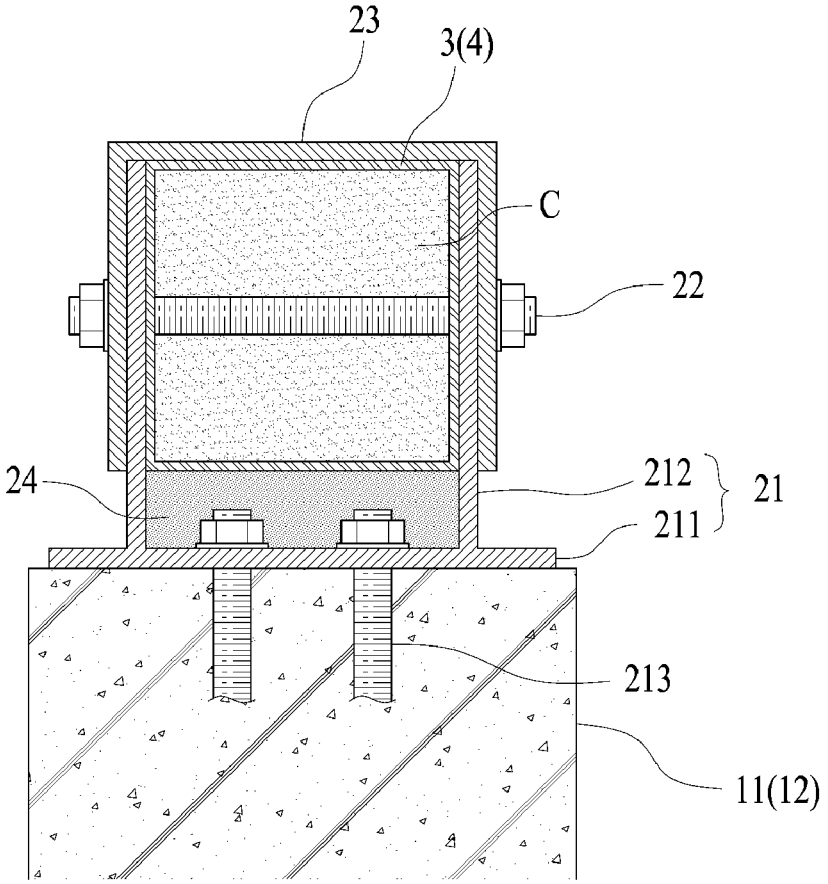

[FIG 18]
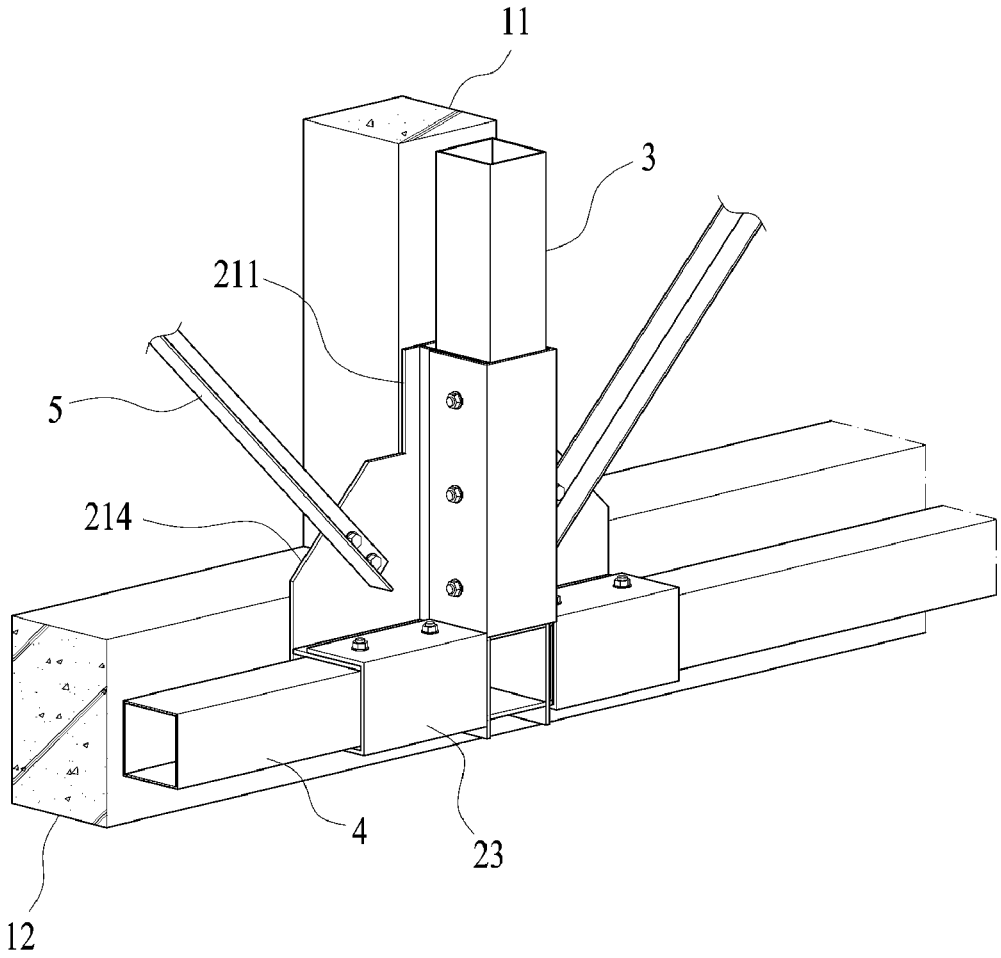

ANTI-SEISMIC REINFORCEMENT STRUCTURE USING PANEL ZONE REINFORCING FIXTURES AND CONSTRUCTION METHOD THEREFOR

TECHNICAL FIELD

The present invention relates to a seismic reinforcement structure using panel zone reinforcing fixtures and a construction method therefor, which can minimize field work, secure the quality, and provide sufficient seismic performance through an integrated behavior with the existing structure since end portions of a reinforced column and a reinforced beam, which are reinforcing members, are combined with panel zone reinforcing fixtures closely combined with a panel zone, which is a column-beam connection part of the existing frame.

BACKGROUND ART

Recently, because the frequency of earthquake occurrence increases all over various countries of the world and the frequency of earthquake occurrence and magnitude increase even in Korea, people need to prepare for earthquake.

Especially, there are still a lot of buildings constructed before 1988 when seismic design has been introduced. Moreover, as lots of earthquake damages in connection with the existing low-rise buildings to which seismic design regulations have never been applied have also been reported, a fair number of the low-rise buildings were included in targets for seismic design application. So, demand for seismic reinforcement to the existing buildings or structures increases considerably.

Korean Patent No. 10-1185974 discloses a reinforcement apparatus for a column-beam connection part using a bracing member and a structure reinforcement method using the same. In Korean Patent No. 10-1185974, a steel frame is installed inside a Rahmen structure frame consisting of the existing columns and the existing beams in order to increase rigidity and ductility for seismic reinforcement.

However, in the case of the conventional seismic reinforcement method, reinforcing members are directly fixed on the sides of the existing member, such as columns or beams. So, the conventional seismic reinforcement method requires boring work to bore a concrete structure for anchoring, and H-beams which are open sections are used as reinforcing members in order to perform boring work.

However, the H-beam requires lots of reinforcing members, such as a stiffener, in order to reinforce the weak axis direction or to prevent lateral buckling since the cross-section of the H-beam has a great difference in rigidity between a strong axis and a weak axis in cross section of the H-beam. In this instance, it is difficult to install a structure on the spot without heavy equipment since the scale and weight of the members are considerable. Furthermore, because the connection part between the members is mainly bonded by field welding, it is difficult to secure the quality, work efficiency is deteriorated, and a construction period of time and construction expenses are increased.

Additionally, in the case that there is an actual survey error of the existing members or a production error of the reinforcing members, it is difficult to absorb the error.

Meanwhile, in Korean Patent No. 10-1060708 or Korean Patent No. 10-1901435, reinforcing members are connected to the existing structure using connection members for load transfer, such as load transfer plates.

However, the conventional arts have a disadvantage in that seismic performance is deteriorated since there is a limitation in integrated behavior between the reinforcing members and the existing structure. Additionally, the conventional arts have further disadvantages in that the conventional arts are structurally weak since stress is concentrated on the connection member parts, and in that it is difficult to secure effective seismic performance having structural performance lower than the reinforcing members.

DISCLOSURE

Technical Problem

Accordingly, the present invention has been made in an effort to solve the above-mentioned problems occurring in the prior arts, and it is an object of the present invention to provide a seismic reinforcement structure using panel zone reinforcing fixtures and a construction method therefor, which can minimize field work, secure the quality, and provide sufficient seismic performance through an integrated behavior with the existing structure since end portions of a reinforced column and a reinforced beam, which are reinforcing members, are combined with panel zone reinforcing fixtures closely combined with a panel zone, which is a column-beam connection part of the existing frame.

Technical Solution

To achieve the above objects, the present invention provides a seismic reinforcement structure which is combined with one side of the existing frame in order to reinforce the existing frame having columns and beams which are existing members, including: panel zone reinforcing fixtures respectively fixed to one side of a column and one side of a beam in a panel zone where the existing column and the existing beam are joined; a reinforcing column which is mounted at one side of the column and of which both ends are respectively fixed to the panel zone reinforcing fixtures; and a reinforcing beam which is installed at one side of the beam and of which both ends are respectively fixed to the panel zone reinforcing fixtures.

According to a preferred embodiment, the panel zone reinforcing fixture includes: a rib reinforcer having a fixed plate fixed at a lateral side of the existing column or the existing beam and a pair of rib plates protruding on the front surface of the fixed plate to be spaced apart from each other; and fastening bolts for fastening the reinforcing column or the reinforcing beam, of which end portions are inserted between a pair of the rib plates.

According to a preferred embodiment, a "□"-shaped reinforcing cap is joined to the outer face of the rib plate into which the reinforcing column or the reinforcing beam is inserted, and is fastened by the fastening bolts.

According to a preferred embodiment, a space between the fixed plate, which is located between a pair of the rib plates, and the reinforcing column or the reinforcing beam is filled with a filler.

According to a preferred embodiment, the fixed plate of the rib reinforcer protrudes outwards from the rib plate, and a support member is disposed between the outer face of the rib plate and the fixed plate.

According to a preferred embodiment, at least one among the reinforcing column and the reinforcing beam is a steel pipe, and the steel pipe is charged with concrete.

According to a preferred embodiment, an expansion plate is formed between the fixed plate of the rib reinforcer located on the existing column and the fixed plate of the rib reinforcer located on the existing beam, and an end portion of a bracing member is joined to the expansion plate.

According to a preferred embodiment, there is provided a construction method of a seismic reinforcement structure using panel zone reinforcing fixtures, the method including the steps of: (a) attaching a rib reinforcer to one side of a panel zone where the existing column and the existing beam of the existing frame are joined; (b) inserting an end portion of a reinforcing column or a reinforcing beam between a pair of rib plates of the rib reinforcer, combining a reinforcing cap, and joining fastening bolts; and (c) filling a space between the fixed plate, which is disposed between a pair of the rib plates, and the reinforcing column or the reinforcing beam with a filler.

According to a preferred embodiment, after the step (c), the construction method further includes the step of (d) filling the inside of a steel pipe, which is at least one among the reinforcing column and the reinforcing beam, with concrete.

Advantageous Effects

As described above, the present invention has the following effects.

First, the present invention can reinforce the panel zone and strengthen rigidity and ductility of the existing structure by transferring load, which acts to the existing structure, to the reinforcing members through the panel zone reinforcing fixtures since end portions of the reinforcing column and the reinforcing beam, which are the reinforcing members, are joined to the panel zone reinforcing fixtures closely joined to the panel zone, which is a column-beam connection part of the existing frame, thereby providing sufficient seismic performance.

Second, since the reinforcing column and the reinforcing beam are not fixed to the existing members but are simply joined to the panel zone reinforcing fixtures, there is no need to form anchoring holes in the existing concrete structure to fix the reinforcing members, thereby being easy to install and making field work simple.

Third, the present invention can effectively reinforce the panel zone through integrated behaviors with the existing structure since the fixed plate of the rib reinforcer of the panel zone reinforcing fixture is closely fixed and integrated to the panel zone of the existing frame and the rib plates protrude from the whole surface of the fixed plate to provide great rigidity.

Fourth, the present invention can secure the quality since the reinforcing column and the reinforcing beam are fixed by the fastening bolts of which the end portions are inserted between a pair of the rib plates, and can easily fix the reinforcing members to the rib plates by adjusting the locations of insertion holes for the fastening bolts. Therefore, the present invention can absorb an actual survey error or a production error.

DESCRIPTION OF DRAWINGS

FIG. 1 is a perspective view illustrating a seismic reinforcement structure using panel zone reinforcing fixtures according to the present invention.

FIG. 2 is a perspective view illustrating a rib reinforcer according to an embodiment of the present invention.

FIG. 3 is a perspective view illustrating a combination relation between the existing member and the rib reinforcer.

FIG. 4 is a perspective view illustrating a combination relation among the rib reinforcer, a reinforcing member and a reinforcing cap.

FIG. 5 is a perspective view illustrating a state where the reinforcing member is combined with a panel zone reinforcing fixture.

FIGS. 6 and 7 are sectional views illustrating states where the reinforcing members are the panel zone reinforcing fixtures.

FIG. 8 is a sectional view illustrating a state where the panel zone reinforcing fixture and the reinforcing member are combined with each other by a fastening bolt according to an embodiment of the present invention.

FIG. 9 is a sectional view illustrating a state where the panel zone reinforcing fixture and the reinforcing member are combined with each other by a fastening bolt according to another embodiment of the present invention.

FIG. 10 is a sectional view illustrating a combination relation between the panel zone reinforcing fixture and the reinforcing member which is a round steel pipe.

FIG. 11 is a sectional view illustrating a combination relation between the panel zone reinforcing fixture and an H-beam reinforcing member.

FIG. 12 is a perspective view illustrating a rib reinforcer according to another embodiment of the present invention.

FIGS. 13 and 14 are perspective views illustrating examples that a reinforcement structure is constructed on an inner edge of the existing frame.

FIG. 15 is a perspective view illustrating a rib reinforcer reinforced by a support member according to an embodiment.

FIG. 16 is a perspective view illustrating a rib reinforcer reinforced by a support member according to another embodiment.

FIG. 17 is a sectional view illustrating a reinforcing member charged with concrete.

FIG. 18 is a perspective view illustrating a combination relation between the panel zone reinforcing fixture and a bracing member.

BEST MODE

To achieve the above objects, the present invention provides a seismic reinforcement structure using panel zone reinforcing fixtures, which is combined with one side of the existing frame in order to reinforce the existing frame having columns and beams which are existing members, including: panel zone reinforcing fixtures respectively fixed to one side of a column and one side of a beam in a panel zone where the existing column and the existing beam are joined; a reinforcing column which is mounted at one side of the column and of which both ends are respectively fixed to the panel zone reinforcing fixtures; and a reinforcing beam which is installed at one side of the beam and of which both ends are respectively fixed to the panel zone reinforcing fixtures.

MODE FOR INVENTION

Hereinafter, preferred embodiments of the present invention will now be described in detail with reference to the attached drawings.

FIG. 1 is a perspective view illustrating a seismic reinforcement structure using panel zone reinforcing fixtures according to the present invention.

As illustrated in FIG. 1, the seismic reinforcement structure using panel zone reinforcing fixtures according to the present invention is combined with one side of the existing frame 1 in order to reinforce the existing frame 1 having columns 11 and beams 12 which are existing members. The seismic reinforcement structure includes: panel zone reinforcing fixtures 2 respectively fixed to one side of a column 11 and one side of a beam 12 in a panel zone where the existing column 11 and the existing beam 12 are joined; a reinforcing column 3 which is mounted at one side of the column 11 and of which both ends are respectively fixed to the panel zone reinforcing fixtures 2; and a reinforcing beam 4 which is installed at one side of the beam 12 and of which both ends are respectively fixed to the panel zone reinforcing fixtures 2.

The present invention relates to a seismic reinforcement structure using panel zone reinforcing fixtures and a construction method therefor, which can minimize field work, secure the quality, and provide sufficient seismic performance through an integrated behavior with the existing structure.

In the seismic reinforcement structure using panel zone reinforcing fixtures according to the present invention, the panel zone reinforcing fixtures 2 are respectively joined to one side of the column 11 and one side of the beam 12 in the panel zone where the existing column 11 and the existing beam 12 are joined, and an end portion of the reinforcing column 3 and an end portion of the reinforcing beam 4 are respectively fixed and joined to the panel zone reinforcing fixtures 2.

The panel zone reinforcing fixtures 2 just fix the reinforcing column 3 and the reinforcing beam 4, which are reinforcing members, to the existing column 11 and the existing beam 12, which are the existing members.

The reinforcing members are the reinforcing column 3 and the reinforcing beam 4.

Moreover, the existing members are the column 11 and the beam 12 of the existing frame 1.

Furthermore, in the case of a Rahmen structure, the greatest stress is concentrated on a panel zone which is a column-beam connection part due to a rigid connection of a column and a beam. The panel zone reinforcing fixture 2 according to the present invention is closely fixed to the panel zone in order to enhance panel zone strength of the existing frame structure.

The reinforcing column 3 and the reinforcing beam 4 are respectively installed at one side of the column 11 and at one side of the beam 12, and both ends of the reinforcing column 3 and the reinforcing beam 4 are respectively fixed to the panel zone reinforcing fixtures 2.

A reinforcing column 3 and a reinforcing beam 4 which are installed newly are not fixed to the existing members 11 and but are simply joined to the panel zone reinforcing fixtures 2. Therefore, there is no need to form anchoring holes in the existing concrete structure to fix the reinforcing members 3 and 4. So, the present invention is easy and simple to install.

FIG. 2 is a perspective view illustrating a rib reinforcer according to an embodiment of the present invention, FIG. 3 is a perspective view illustrating a combination relation between the existing member and the rib reinforcer, FIG. 4 is a perspective view illustrating a combination relation among the rib reinforcer, a reinforcing member and a reinforcing cap, FIG. 5 is a perspective view illustrating a state where the reinforcing member is combined with a panel zone reinforcing fixture, FIGS. 6 and 7 are sectional views illustrating states where the reinforcing members are the panel zone reinforcing fixtures, FIG. 8 is a sectional view illustrating a state where the panel zone reinforcing fixture and the reinforcing member are combined with each other by a fastening bolt according to an embodiment of the present invention, FIG. 9 is a sectional view illustrating a state where the panel zone reinforcing fixture and the reinforcing member are combined with each other by a fastening bolt according to another embodiment of the present invention, FIG. 10 is a sectional view illustrating a combination relation between the panel zone reinforcing fixture and the reinforcing member which is a round steel pipe, FIG. 11 is a sectional view illustrating a combination relation between the panel zone reinforcing fixture and an H-beam reinforcing member, FIG. 12 is a perspective view illustrating a rib reinforcer according to another embodiment of the present invention, and FIGS. 13 and 14 are perspective views illustrating examples that a reinforcement structure is constructed on an inner edge of the existing frame.

As illustrated in FIGS. 2 to 5, the panel zone reinforcing fixture 2 includes: a rib reinforcer 21 having a fixed plate 211 fixed at a lateral side of the existing member 11 or 12 and a pair of rib plates 212 protruding on the front surface of the fixed plate 211 to be spaced apart from each other; and fastening bolts 22 for fastening the reinforcing column 3 or the reinforcing beam 4, of which end portions are inserted between a pair of the rib plates 212.

That is, the panel zone reinforcing fixture 2 includes the rib reinforcer 2 and the fastening bolts 22.

The rib reinforcer 21 includes the fixed plate 211 and a pair of the rib plates 212, and is formed in a "□"-shape or a "⊐"-shape of which one side is open.

Because the fixed plate 211 of the rib reinforcer 21 is closely fixed to the panel zone of the existing frame 1, the rib reinforcer 21 is integrated with the existing frame 1.

A pair of the rib plates 212 protrude on the front surfaces of the fixed plate 211 to provide great rigidity. Therefore, the rib reinforcer 21 can effectively reinforce the panel zone where the existing column 11 and the existing beam 12 are joined and stress is concentrated.

The rib plates 212 improve strength of the panel zone by increasing rigidity of the rib reinforcer 21 and connect the reinforcing column 3 and the reinforcing beam 4 with each other by fixing an end portion of the reinforcing column 3 or the reinforcing beam 4.

Epoxy is grouted between the fixed plates 211 and the existing members 11 and 12.

The fixed plates 211 are fixed to the existing members 11 and 12 by anchor bolts 213 (See FIG. 3).

The anchor bolts 213 may be disposed inside a pair of the rib plates 212 or may be disposed outside a pair of the rib plates 212 (See FIGS. 6 and 7).

The fastening positions of the anchor bolts 213 may be determined according to a mounting position of the rib reinforcer and sizes of the existing members 11 and 12.

The fastening bolts 22 fix the reinforcing column 3 or the reinforcing beam 4 of which the end portion is inserted between a pair of the rib plates 212 (See FIGS. 4 and 5).

Therefore, if locations of insertion holes for inserting the fastening bolts 22 are adjusted on the reinforcing members 3 and 4, the reinforcing members 3 and 4 can be fixed to the rib plates 212. Therefore, the present invention can easily absorb an actual survey error or a production error.

The fastening bolts 22 are long bolts so as to perforate a pair of the rib plates 212 and the reinforcing members 3 and 4 to fix them (See FIG. 8). Additionally, the fastening bolts 22 are one-way bolts so as to respectively fix both sides of the reinforcing members 3 and 4 (See FIG. 9).

Because the reinforcing column 3 and the reinforcing beam 4 are joined to the panel zone reinforcer 2 and are fixed to the existing frame 1 just by the fastening bolts 22, the reinforcing members 3 and 4 may be round steel pipes or square steel pipes as illustrated in FIG. 10. In addition, as illustrated in FIG. 11, H-shaped steel reinforcing members 3 and 4 may be used.

The panel zone reinforcing fixtures 2 according to the present invention reinforce the panel zone of the existing frame 1 by themselves. Additionally, the panel zone reinforcing fixtures 2 connect the existing members 11 and 12 and the reinforcing members 3 and 4 with each other to transfer load acting to the existing frame 1 to the reinforcing column 3 and the reinforcing beam 4, thereby reinforcing rigidity and ductility of the structure.

The panel zone reinforcing fixtures 2 are respectively fixed to one side of the column 11 and one side of the beam 12.

For instance, it is illustrated that the panel zone reinforcing fixtures 2 are fixed on the outer faces of the existing members 11 and 12.

As illustrated in FIG. 2, the panel zone reinforcing fixture 2 is formed in the shape of "T" or "⊥", and may be closely joined to the outer surface of the panel zone of the existing members 11 and 12.

At both sides of the panel zone reinforcing fixture 2, joined is the reinforcing beam 4 to the front surface of the existing beam 12. The reinforcing column 3 is joined to the front surface of the existing column 11, and then, is fixed to the upper portion or the lower portion of the panel zone reinforcing fixture 2 (See FIG. 1).

Next, it is illustrated that the panel zone reinforcing fixtures 2 are fixed to inner edges of the existing members 11 and 12.

As illustrated in FIG. 12, the panel zone reinforcing fixtures 2 is formed in the shape of "]" or "⌊", and are closely joined to the inner surfaces of the edges of the column 11 and the beam 12.

Moreover, the reinforcing column 3 is joined to the inner surface of the existing column 11, and the reinforcing beam 4 is joined and fixed on the lower surface or the upper surface of the existing beam 12 (See FIGS. 13 and 14).

As illustrated in FIG. 4, a "⊏"-shaped reinforcing cap 23 is joined to the outer face of the rib plate 212 into which the reinforcing column 3 or the reinforcing beam 4 is inserted, and then, is fastened by the fastening bolts 22.

The reinforcing cap 23 has a "⊏"-shaped section to surround and fix the outer face of the rib plate 212 into which the reinforcing column 3 or the reinforcing beam 4 is inserted.

The reinforcing cap 23 has a length corresponding to the length of the rib plate 212 so as to surround predetermined areas of end portions of the reinforcing members 3 and 4.

The reinforcing cap 23 and the rib reinforcer 21 are closely disposed to surround the predetermined areas of the end portions of the reinforcing members 3 and 4 to restrict the reinforcing members 3 and 4 in an enclosed type.

Therefore, the present invention shows mutually integrated behaviors of the reinforcing members 3 and 4 and the panel zone reinforcing fixtures 2, enhances ductility by preventing buckling of the reinforcing members 3 and 4, and disperses and mitigates stress around the fastening bolts 22.

Of course, as illustrated in FIG. 6, just the rib reinforcer 21 without the reinforcing cap 23 may be disposed.

Moreover, as illustrated in FIG. 7, in place of the reinforcing cap 23, it is also possible that end portions of the rib plates 212 are connected with each other to form the rib reinforcer 21 in a closed type. In this instance, the reinforcing member 3 or 4 is fit to one side of the rib reinforcer 21 so as to be joined between a pair of the rib plates 212.

FIGS. 13 and 14 illustrate an example that the panel zone reinforcing fixtures 2 are mounted at the inner edges of the existing frame 1, wherein FIG. 13 illustrates a state where the reinforcing column 3 is fixed by the reinforcing cap 23, and FIG. 14 illustrates a state where the reinforcing beam 4 is fixed by the reinforcing cap 23.

As illustrated in FIG. 8, a space between the fixed plate 211, which is located between a pair of the rib plates 212, and the reinforcing column 3 or the reinforcing beam 4 is filled with a filler 24.

The anchor bolts 213 for fixing the fixed plate 211 to the existing frame 1 are exposed to the outside of the fixed plate 211. In order to avoid interference between the anchor bolts 213 and the reinforcing members 3 and 4, the reinforcing members 3 and 4 may be mounted to be spaced apart from the surface of the fixed plate 211 at a predetermined interval.

Then, the reinforcing members 3 and 4 cannot move in the integrated behavior with the panel zone reinforcing fixtures 2, the space between the reinforcing members 3 and 4 and the fixed plate 211 is filled with the filler 24 so as to remove a gap, so that the reinforcing members 3 and 4 can move integrally with the panel zone reinforcing fixtures 2.

In this instance, a head part of the anchor bolt 213 is buried in the filer 24 so as to prevent corrosion of the anchor bolts 213.

In the case that the reinforcing members 3 and 4 are formed to have a round section or an open section like an H-shaped steel, a blocking plate is mounted at one side of the reinforcing members 3 and 4 facing the anchor bolts 213, and the filler 24 is filled between the blocking plate and the fixed plate 211.

Furthermore, in the case that an available space is formed among the rib plate 212, the reinforcing cap 23, and the reinforcing members 3 and 4 in order to absorb a construction error, to easily insert the reinforcing members 3 and 4 into the rib reinforcer 21 on the spot, and to easily combine the reinforcing cap 23, the filler 24 is filled in the whole space among the rib plate 212, the reinforcing cap 23, and the reinforcing members 3 and 4, so that the reinforcing members 3 and 4 are integrated with the rib reinforcer 21 and the reinforcing cap 23.

The filler 24 may be made of synthetic resin such as epoxy, or high-strength non-shrink mortar.

FIG. 15 is a perspective view illustrating a rib reinforcer reinforced by a support member according to an embodiment, and FIG. 16 is a perspective view illustrating a rib reinforcer reinforced by a support member according to another embodiment.

As illustrated in FIGS. 15 and 16, the fixed plate 211 of the rib reinforcer 21 protrudes outwards from the rib plate 212, and a support member 25 is disposed between the outer face of the rib plate 212 and the fixed plate 211.

The rib reinforcer 21 can reinforce the panel zone of the existing frame 1, and load is concentrated on the rib reinforcer 21 since end portions of the reinforcing members 3 and 4 are fixed thereto.

Therefore, if the rib reinforcer 21 consists of only the fixed plate 211 and the rib plates 212 are fixed, the rib reinforcer 21 may lack rigidity.

So, the rib reinforcer 21 is generally formed in the shape of "ㅗ", and the support member 25 is joined between the fixed plate 211 and the rib plate 212 in order to reinforce the rib reinforcer 21.

The support member 25 may be a rectangular pipe as illustrated in FIG. 15, or may be a reinforcing rib as illustrated in FIG. 16. However, the shape of the support member 25 is not limited to the above, and various examples may be applied to the support member 25.

FIG. 17 is a sectional view illustrating a reinforcing member charged with concrete.

As illustrated in FIG. 17, at least one among the reinforcing column 3 and the reinforcing beam 4 is a steel pipe, and the steel pipe is charged with concrete (C).

The reinforcing members 3 and 4 may be a steel pipe having a closed section since they are not directly fixed on the existing frame 1.

In the case that the reinforcing members 3 and 4 are the steel pipes, the steel pipe is charged with concrete (C) to form a CFT structure so that the reinforcing members 3 and 4 are minimized in cross-section size.

FIG. 18 is a perspective view illustrating a combination relation between the panel zone reinforcing fixture and a bracing member.

As illustrated in FIG. 18, an expansion plate 214 is formed between the fixed plate 211 of the rib reinforcer 21 located on the column 11 and the fixed plate 211 of the rib reinforcer 21 located on the beam 12, and an end portion of a bracing member 5 is joined to the expansion plate 214.

If lateral force is large, the bracing member 5 can reinforce a structure. In the present invention, the bracing member 5 can be easily joined using the fixed plate 211 of the rib reinforcer 21.

That is, the expansion plate 214 connects the fixed plate 211 of the rib reinforcer 21 located on the column 11 and the fixed plate 211 of the rib reinforcer 21 located on the beam 12 with each other, and the end portion of the bracing member is joined to the expansion plate 214.

The expansion plate 214 may be formed integrally in such a way that the fixed plates 211 located at both sides are extended. Alternatively, the expansion plate 214 may be formed in such a way that a plate is fixed to the fixed plates 211 located at both sides by welding or bolting.

Now, a construction method of a seismic reinforcement structure using panel zone reinforcing fixtures will be described.

The construction method of a seismic reinforcement structure using panel zone reinforcing fixtures according to the present invention includes a step of (a) attaching the rib reinforcer 21 to one side of a panel zone where the existing column 11 and the existing beam 12 of the existing frame 1 are joined.

The one side of the existing frame 1 to which the rib reinforcer 21 will be joined is surface-treated by a grinder, and anchor holes for fixing the rib reinforcer 21 are previously perforated.

The rib reinforcer 21 gets in close contact with the column 11 and the beam 12 of the existing frame 1, and then, anchor bolts 213 are coupled so as to fix the rib reinforcer 21.

In this instance, epoxy is grouted between the fixed plate 211 of the rib reinforcer 21 and the existing members 11 and 12.

The construction method of a seismic reinforcement structure using panel zone reinforcing fixtures according to the present invention further includes a step of (b) inserting an end portion of a reinforcing column 3 or a reinforcing beam 4 between a pair of rib plates 212 of the rib reinforcer 21, combining a reinforcing cap 23, and joining fastening bolts 22.

That is, both end portions of the reinforcing members 3 and 4 are respectively inserted between the rib plates 212 of the rib reinforcer 21, and then, the reinforcing cap 23 of a "ㄷ" shape is put on the outer face of the rib plates 212 to be coupled.

Additionally, the reinforcing cap 23, the rib plates 212, and the reinforcing members 3 and 4 are joined by the fastening bolts 22.

Finally, the construction method of a seismic reinforcement structure using panel zone reinforcing fixtures according to the present invention further includes a step of (c) filling a space between the fixed plate 211, which is disposed between a pair of the rib plates 212, and the reinforcing column 3 or the reinforcing beam 4 with a filler 24.

The filler 24 may be made of synthetic resin such as epoxy, or high-strength non-shrink mortar.

Meanwhile, after the step (c), the construction method of a seismic reinforcement structure using panel zone reinforcing fixtures according to the present invention further includes a step of (d) filling the inside of a steel pipe, which is at least one among the reinforcing column 3 and the reinforcing beam 4, with concrete (C).

In this instance, the fastening bolts 22 joined to the reinforcing members 3 and 4 are buried in the concrete (C) to be fixed integrally.

Furthermore, the reinforcing members 3 and 4 are CFT members. So, the present invention is economical by minimizing the cross-section size of the reinforcing members 3 and 4.

INDUSTRIAL APPLICABILITY

As described above, the seismic reinforcement structure using panel zone reinforcing fixtures according to the present invention does not need any anchoring hole in the existing concrete structure to fix the reinforcing members since the reinforcing column and the reinforcing beam are not fixed to the existing members but are simply joined to the panel zone reinforcing fixtures. Therefore, the seismic reinforcement structure using panel zone reinforcing fixtures has industrial applicability in that it is easy and simple to install.

The invention claimed is:

1. A seismic reinforcement structure which is combined with one side of an existing frame (1) in order to reinforce the existing frame (1) having columns (11) and beams (12) which are existing members, including:

panel zone reinforcing fixtures (2) respectively fixed to one side of the column (11) and one side of the beam (12) in a panel zone where the existing column (11) and the existing beam (12) are joined;

a reinforcing column (3) which is mounted at one side of the column (11) and of which both ends are respectively fixed to the panel zone reinforcing fixtures (2); and a reinforcing beam (4) which is installed at one side of the beam (12) and of which both ends are respectively fixed to the panel zone reinforcing fixtures (2), wherein each panel zone reinforcing fixture (2) includes: a rib reinforcer (21) having a fixed plate (211) fixed at a lateral side of the existing member (11, 12) and a pair of rib plates (212) protruding on the front surface of the fixed plate (211) to be spaced apart from each other; and fastening bolts (22) for fastening the reinforcing column (3) or the reinforcing beam (4), wherein end portions of the reinforcing column (3) or the reinforcing beam (4) are inserted between a pair of the rib plates (212), and wherein a "⊏"-shaped reinforcing cap (23) is joined to the outer face of the rib plate (212) into which the reinforcing column (3) or the reinforcing beam (4) is inserted, and is fastened by the fastening bolts (22).

2. The seismic reinforcement structure according to claim 1, wherein a space between the fixed plate (211), which is located between a pair of the rib plates (212), and the reinforcing column (3) or the reinforcing beam (4) is filled with a filler (24).

3. The seismic reinforcement structure according to claim 1, wherein the fixed plate (211) of the rib reinforcer (21) protrudes outwards from the rib plate (212), and a support member (25) is disposed between the outer face of the rib plate (212) and the fixed plate (211).

4. The seismic reinforcement structure according to claim 1, wherein at least one among the reinforcing column (3) and the reinforcing beam (4) is a steel pipe, and the steel pipe is charged with concrete (C).

5. The seismic reinforcement structure according to claim 1, wherein an expansion plate (214) is formed between the fixed plate (211) of the rib reinforcer (21) located on the column (11) and the fixed plate (211) of the rib reinforcer (21) located on the beam (12), and an end portion of a bracing member (5) is joined to the expansion plate (214).

6. A construction method of a seismic reinforcement structure using panel zone reinforcing fixtures according to claim 2, the construction method comprising the steps of:

(a) attaching the rib reinforcer (21) to one side of a panel zone where the existing column (11) and the existing beam (12) of the existing frame (1) are joined;

(b) inserting an end portion of a reinforcing column (3) or a reinforcing beam (4) between a pair of rib plates (212) of the rib reinforcer (21), combining a reinforcing cap (23), and joining fastening bolts (22); and (c) filling a space between the fixed plate (211), which is disposed between a pair of the rib plates (212), and the reinforcing column (3) or the reinforcing beam (4) with a filler (24).

7. The construction method according to claim 6, after the step (c), further comprising the step of:

(d) filling the inside of a steel pipe, which is at least one among the reinforcing column 3 and the reinforcing beam (4), with concrete (C).

* * * * *